US005943836A

United States Patent [19]

Kassardjian

[11] Patent Number: 5,943,836

[45] **Date of Patent: *Aug. 31, 1999**

[54] PROTECTIVE COVER FOR CONCRETE REINFORCING BAR

[75] Inventor: Vasken Kassardjian, Newport Beach, Calif.

[73] Assignee: Don De Cristo Concrete Accessories, Inc., Irvine, Calif.

[ * ] Notice: This patent is subject to a terminal disclaimer.

[21] Appl. No.: 09/150,338

[22] Filed: Sep. 10, 1998

[51] Int. Cl.[6] ..... E04H 12/00; E04C 5/16

[52] U.S. Cl. ..... 52/301; 52/300; 52/289.1; 52/689; 248/523

[58] Field of Search ..... 52/300, 301, 682, 52/687–689, 740.1, 741.3; 248/523; 138/96 R; 135/86, 77; 74/558, 553

[56] References Cited

U.S. PATENT DOCUMENTS

| | | | |
|---|---|---|---|
| Re. 33,764 | 12/1991 | Cochrane | 215/232 |
| D. 262,093 | 12/1981 | Bush et al. | D8/386 |
| D. 363,657 | 10/1995 | Kassardjian et al. | D8/354 |
| 1,083,120 | 12/1913 | May . | |
| 2,131,319 | 9/1938 | Greenholtz et al. | 18/30 |
| 2,215,251 | 9/1940 | Prince | 138/96 |
| 3,007,726 | 11/1961 | Parkin | 287/53 |
| 3,199,819 | 8/1965 | Widmark | 248/188.9 |
| 3,233,502 | 2/1966 | Fernberg | 85/80 |
| 3,485,271 | 12/1969 | Halsey | 138/96 |
| 3,693,310 | 9/1972 | Middleton | 52/685 |
| 3,741,226 | 6/1973 | Urban | 135/62 |
| 3,890,990 | 6/1975 | Schafer | 135/20 R |
| 4,000,539 | 1/1977 | Neyer | 16/121 |
| 4,012,806 | 3/1977 | Howie, Jr. | 16/121 |
| 4,080,770 | 3/1978 | Vigh | 52/689 |
| 4,098,283 | 7/1978 | Tritle, Jr. | 135/77 |
| 4,119,290 | 10/1978 | Gies | 248/523 |
| 4,140,451 | 2/1979 | Herdzina, Jr. et al. | 425/129 R |
| 4,159,096 | 6/1979 | Chase | 248/523 |
| 4,179,771 | 12/1979 | Rankins et al. | 16/121 |
| 4,202,378 | 5/1980 | Bush et al. | 138/96 R |
| 4,269,010 | 5/1981 | Glass | 52/154 |
| 4,338,270 | 7/1982 | Uffindell | 264/46.4 |
| 4,575,978 | 3/1986 | Huhn et al. | 52/234 |
| 4,644,726 | 2/1987 | Wheeler | 52/677 |
| 4,655,023 | 4/1987 | Yung | 52/685 |

(List continued on next page.)

FOREIGN PATENT DOCUMENTS

| | | |
|---|---|---|
| 11 57 436 | 11/1963 | Germany . |
| 18 10 356 | 11/1968 | Germany . |
| 25 34 928 | 8/1975 | Germany . |
| 40 36 919 | 11/1990 | Germany . |
| WO 91/14839 | 10/1991 | WIPO . |

OTHER PUBLICATIONS

Don De Cristo Concrete Accessories, Inc. Catalog, Plastic Rebar Guard, p. 43.

Deslauriers, Inc. Brochure, "Deslauriers Implament–Protection Safety Cap DISC System".

*Primary Examiner*—Carl D. Friedman
*Assistant Examiner*—Winnie Yip
*Attorney, Agent, or Firm*—Fitzpatrick, Cella, Harper & Scinto

[57] ABSTRACT

A protective cover covers an end of a concrete reinforcing bar so as to prevent injuries caused by coming into contact with the end of the concrete reinforcing bar. The protective cover includes an elongated cylindrical collar for securing the protective cover to the exposed end of the concrete reinforcing bar, a cap which is arranged perpendicularly to the elongated cylindrical collar, and a seat having retaining sides which retain the concrete reinforcing bar within the seat, the seat disposed between the elongated cylindrical collar and the cap. The seat can have any shape that includes retaining sides which retain an end portion of the reinforcing bar within the seat. Examples of such shapes include frustrum-like shapes, prism-like shapes, cylindrical-like shapes, and sheet-like shapes with retaining sides in the form of a washer or a ring.

45 Claims, 6 Drawing Sheets

U.S. PATENT DOCUMENTS

| | | | |
|---|---|---|---|
| 4,694,863 | 9/1987 | Klopp | 138/96 R |
| 4,824,136 | 4/1989 | Bobby | 280/475 |
| 4,833,850 | 5/1989 | Lunn | 52/301 |
| 4,899,771 | 2/1990 | Wilkinson | 135/77 |
| 4,939,830 | 7/1990 | Janian | 29/173 |
| 4,965,035 | 10/1990 | Ishiwatari et al. | 264/268 |
| 4,972,642 | 11/1990 | Strobl, Jr. | 52/297 |
| 5,037,595 | 8/1991 | Kornelis | 264/153 |
| 5,088,513 | 2/1992 | Ostermeyer | 135/82 |
| 5,313,757 | 5/1994 | Schnepf | 52/301 |
| 5,353,825 | 10/1994 | Davis | 135/78 |
| 5,363,618 | 11/1994 | Underwood | 52/301 |
| 5,381,636 | 1/1995 | Kassardjian et al. | 52/301 |
| 5,444,957 | 8/1995 | Roberts | 52/745.05 |
| 5,447,290 | 9/1995 | Workman | 256/59 |
| 5,523,043 | 6/1996 | Kassardjian et al. | 264/273 |
| 5,568,708 | 10/1996 | Kassardjian et al. | 52/301 |
| 5,600,927 | 2/1997 | Kennon | 52/301 |
| 5,613,336 | 3/1997 | Workman | 52/301 |
| 5,687,772 | 11/1997 | Underwood | 138/96 R |
| 5,729,941 | 3/1998 | Kassardjian et al. | 52/301 |
| 5,824,253 | 10/1998 | Kassardjian et al. | 264/275 |

PROTECTIVE COVER FOR CONCRETE REINFORCING BAR

BACKGROUND OF THE INVENTION

1. Field of the Invention

The present invention relates to a protective cover for covering the end of a rod, and more particularly, to a protective cover used during construction for placement over the projecting end of a steel reinforcing bar.

2. Description of the Related Art

Typically, concrete structures, such as office buildings or highway overpasses, include steel reinforcing bars, oriented in both horizontal and vertical directions, which are placed in concrete forms prior to pouring the concrete. During construction, the steel reinforcing bars pose a safety hazard. For example, workers at grade level might be stabbed or gouged by the exposed ends of the reinforcing bars. Even worse, workers above grade, such as workers on scaffoldings, might fall and become impaled on top of vertically-rising reinforcing bars.

In an attempt to reduce injury to workers, conventional bar guards, such as the type disclosed in U.S. Pat. No. 4,202,378, have been used to protect workers from being scraped or stabbed by the projecting end of reinforcing bars at grade level. Although adequate for protecting against such scrapes and stabs, those conventional bar guards were not designed to, and do not, protect against the substantially-greater forces involved when a worker falls onto vertically-rising reinforcing bars.

Realizing the dangers presented by exposed ends of reinforcing bars at construction sites, and recognizing that conventional bar guards do not prevent a worker from being impaled, divisions of the Occupational Safety and Health Standards Board (OSHA) have enacted safety standards requiring the use of protective covers for covering the exposed ends of reinforcing steel bars, so as to further protect against injury and impalement. The standards are intended to protect workers, working at grade or above grade, who are exposed to reinforcing steel or other projections, against the hazard of impalement by requiring that the exposed end of each reinforcing bar be covered with a protective cover.

The OSHA standard requires that: the surface of the protective cover shall be no smaller than a 4-inch×4-inch square; the protective cover shall be made of wood, plastic, or similar material; and the protective cover shall be capable of withstanding, at a minimum, the impact of a 250-pound weight dropped from a height of ten feet without penetration failure of the cover. This OSHA standard for protective covers is believed to provide substantial protection for workers at grade and above grade on construction sites.

In order to meet OSHA requirements and address the need for a protective cover which would not only prevent gouging and scraping but also impalement, the assignee of the present invention invented two types of protective covers, as disclosed in U.S. Pat. Nos. 5,381,636 and 5,729,941, which comply with the OSHA standards.

SUMMARY OF THE INVENTION

The present invention provides an improved protective cover which in one embodiment is adapted to cover an exposed end of a concrete reinforcing bar or other projection, and in another embodiment is adapted to be removably combined with a conventional bar guard.

According to one embodiment of the invention, the improved protective cover comprises an elongated cylindrical collar for securing the protective collar to the exposed end of the concrete reinforcing bar, a cap which is arranged perpendicularly to the elongated cylindrical collar, and a seat having retaining sides which retain the concrete reinforcing bar within the seat. The seat is disposed between the elongated cylindrical collar and the cap.

In the preferred embodiment, the seat has a closed end and an open end, and the seat is positioned such that the closed end is directed toward the cap. In addition, the elongated cylindrical collar, the seat and the cap are integrally formed into a single unitary member.

According to another embodiment of the invention, the improved protective cover is detachably assembled and comprises a bar guard portion comprising a collar section integrally formed with a top portion at one end and dimensioned at the other end to receive within the collar an end portion of the concrete reinforcing bar; a cover portion having a bar guard receptacle for detachably receiving the top portion of the bar guard portion and a cap which is arranged perpendicularly to the bar guard receptacle; and a seat having retaining sides which retain the concrete reinforcing bar within the seat. The seat is adapted to be placed between the bar guard portion and the cover portion. In the preferred embodiment, the seat has a closed end and an open end, and when the seat is positioned between the bar guard portion and the cover portion, the seat is oriented such that the open end of the seat is directed towards the bar guard portion when the bar guard portion is detachably received in the cover portion.

According to still another embodiment of the invention, the protective cover is for attaching to a conventional concrete reinforcing bar guard, the conventional bar guard having a collar which includes inwardly-extending fins for grasping a reinforcing bar and a mushroom-shaped top perpendicularly attached to the collar. The protective cover according to this embodiment comprises a collar-shaped receptacle having inwardly-extending means for detachably securing to the mushroom-shaped top of the conventional bar guard, a cap which is perpendicularly attached to the collar-shaped receptacle and a seat having retaining walls which retain the reinforcing bar within the seat. The seat is disposed within the collar-shaped receptacle. In the preferred embodiment, the seat has a closed end and an open end. The closed end of the seat is directed towards the cap, and when the conventional bar guard is fixedly secured to the collar-shaped receptacle, the open end of the seat is directed towards the mushroom-shaped top of the conventional bar guard.

In the foregoing embodiments, the seat can have any shape that includes retaining sides which retain the end portion of the reinforcing bar within the seat. Examples of such shapes include frustrum-like shapes, prism-like shapes, cylindrical-like shapes, and sheet-like shapes with retaining sides in the form of a washer or a ring.

The protective cover of the present invention not only provides workers with protection from being stabbed or gouged by an exposed end of a reinforcing bar, but also provides improved protection from impalement on a reinforcing bar. In addition, because the seat has retaining sides which retain an end portion of a reinforcing bar within the seat, the seat functions to protect a worker even when the protective cover receives an off-center impact.

DETAILED DESCRIPTION OF THE PREFERRED EMBODIMENT

The protective cover of the present invention is believed to meet current OSHA standards relating to protective covers for reinforcing bars.

Figure 1:
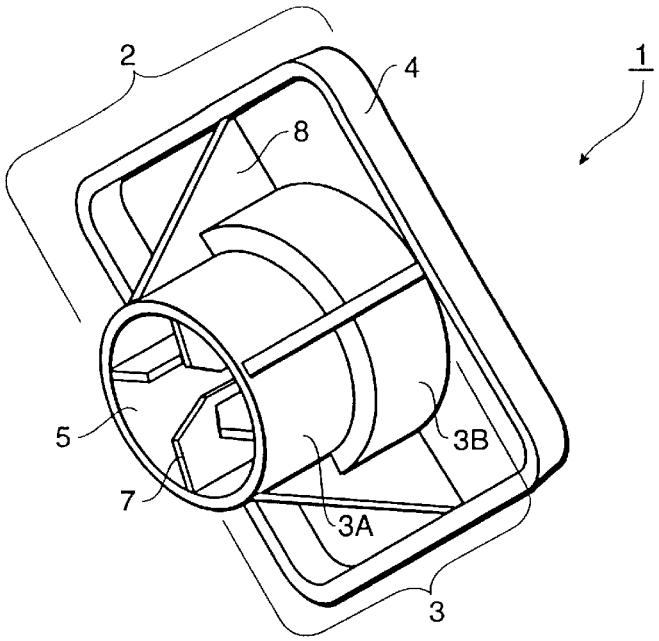
FIG. 1 is a bottom perspective view of the protective cover according to the first embodiment of the present invention.

The first embodiment of the present invention will now be discussed. FIG. 1 is a bottom perspective view of protective cover 1 according to the first embodiment of the invention. Protective cover 1 includes integrally-formed cap-and-collar assembly 2. Cap-and-collar assembly 2 includes a stepped collar section 3 and cap section 4.

As shown in FIG. 1, collar section 3 has a small outer diameter collar 3*a* which is integrally formed at one end with a large outer-diameter collar 3*b*. Collar 3*a* has open end 5 for receiving an end portion of the reinforcing bar. Collar 3*b* has the same inner diameter as collar 3*a*, but a larger outer diameter, for a purpose which will become apparent below.

Inside collar section 3 there are inwardly-extending and off-center fins 7 which secure the reinforcing bar to protective cover 1. Fins 7 flex outwardly so as to accommodate reinforcing bars of varying sizes.

Also shown in FIG. 1 are four radially-extending reinforcing ribs 8 which extend from cap section 4 to a portion of collar section 3. Reinforcing ribs 8 provide connectivity between collar section 3 and cap section 4, and also provide rigidity and structural integrity for cap-and-collar assembly 2. The purpose and effect of reinforcing ribs 8 are to prevent collar section 3 from separating from cap section 4 when a load is dropped or placed against cap section 4, for example, a load equivalent to the impact of a person striking against the protective cover. Reinforcing ribs 8 preferably are integrally formed with, and made from the same material used for, collar section 3 and cap section 4.

Cap-and-collar assembly 2 and reinforcing ribs 8 preferably are made of a resiliently-deformable plastic material such as heavy-duty polyethylene plastic or rubber. The material used for cap-and-collar assembly 2 and reinforcing ribs 8 preferably should be brightly colored so that they can be readily seen when in use on a reinforcing bar.

Figure 2:
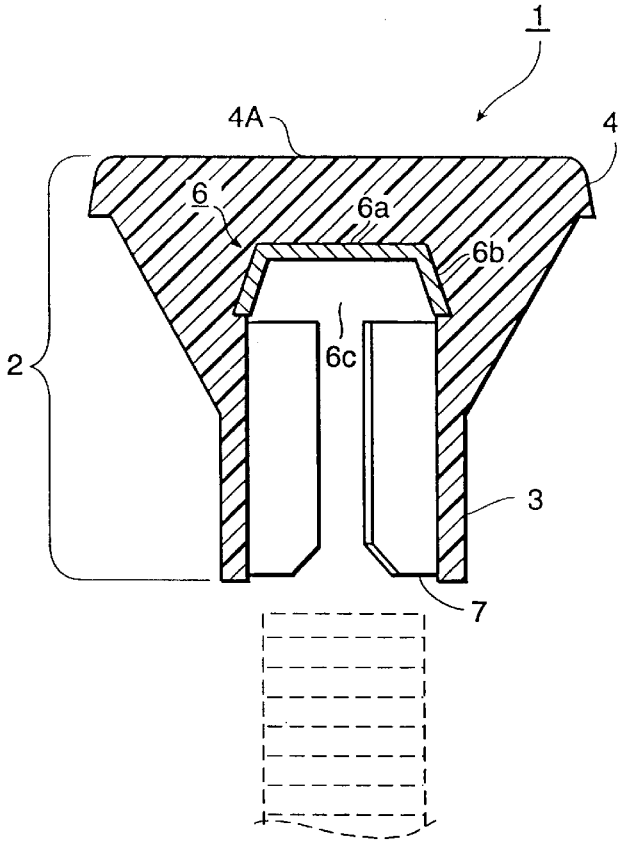
FIG. 2 depicts a longitudinal two-dimensional cross-section of the protective cover according to the first embodiment of the present invention.

FIG. 2 depicts a longitudinal two-dimensional cross-section of protective cover 1 according to the first embodiment of the invention. As shown in FIG. 2, seat 6 is placed at the distal end of collar section 3 and integrally molded within collar 3*b*, leaving exposed only that portion of the surface of seat 6 which coincides with the inner diameter of collar 3*b*.

In a preferred embodiment, cap section 4 has a flat square top surface 4*a* with rounded edges. The dimensions of cap section 4 are designed to meet the OSHA standards for protective covers, and, preferably, top surface 4*a* is four inches by four inches square.

Figure 3A:
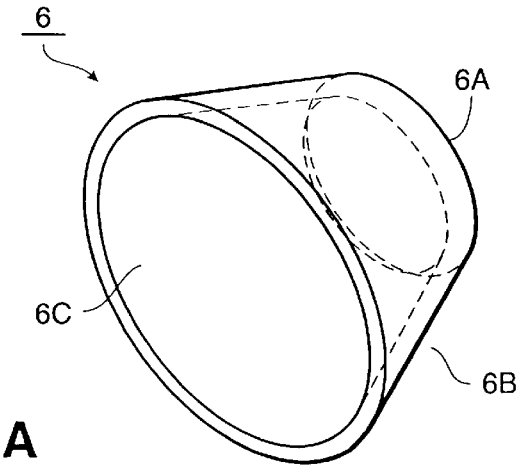
FIGS. 3A through 3H are perspective views of seats according to the present invention.

FIG. 3A is a side perspective view of seat 6. Seat 6 has a frustrum-like shape (i.e., shaped like a cone or pyramid that has been cut off parallel to its base). In FIG. 3A, the frustrum is of a cone-like shape. Seat 6 has closed end 6*a*, retaining sides 6*b* and open end 6*c*.

As shown in FIG. 2, seat 6 is disposed between cap section 4 and collar section 3, such that open end 6*c* is directed toward collar section 3 and closed end 6*a* is directed toward cap section 4. Seat 6 should be made from a rigid metal material and should have an approximate thickness that would prevent penetration of an end of the reinforcing bar through the cover when impacted with a 250-pound weight dropped from a height of ten feet. Preferably, seat 6 is ⅛-inch thick and is manufactured from hot-rolled A36 steel.

As in U.S. Pat. No. 5,381,636, seat 6 may also have slots so that reinforcing ribs 8 can pass from collar section 3 through seat 6 to cap section 4. In this manner, additional rigidity is provided to the protective cover, and movement of metal seat 6 can be prevented.

In operation, when protective cap 1 is placed over an end of a reinforcing bar, the end portion of the reinforcing bar enters open end 5 of collar section 3. Collar section 3 receives the end portion of the reinforcing bar, and the inwardly-extending and off-center fins 7 spread apart so as to accommodate and to secure the bar to protective cover 1. Protective cover 1 is pressed firmly downward onto the bar until the bar is seated against seat 6. Fins 7 detachably retain the reinforcing bar within protective cover 1 until the protective cover has served its purpose. At such time, protective cover 1 can be removed from the reinforcing bar by pulling protective cover 1 in a direction away from the reinforcing bar, and, if necessary, simultaneously twisting protective cover 1.

In the event that a worker comes in contact with protective cover 1 and the point of contact is directly on the center of protective cover 1, the load of force against protective cover 1 will be distributed through cap section 4 and seat 6 directly to the reinforcing bar. On the other hand, if an off-center load or force impacts protective cover 1, the load will be distributed from cap section 4 to seat 6 and reinforcing ribs 8 to collar section 3. In this case, retaining sides 6*b* retain the end portion of the concrete reinforcing bar within the seat. As a result, penetration of the reinforcing bar through the protective cover should be prevented with respect to impacts occurring at a wide range of instant angles.

Generally, with respect to protective covers, upon impact the end of the concrete reinforcing bar moves in a direction of least resistance relative to the cap portion of the protective cover. The effect of such movement in protective covers employing metal seats is that the end of the reinforcing bar essentially attempts to find its way out from underneath the metal seat of the protective cover. However, in the present invention, retaining sides 6*b* of seat 6 prevent the end of the reinforcing bar from finding its way out from under the metal seat because the end of the bar is trapped by the retaining sides. In this regard, protective covers presently in use, excluding the protective covers disclosed in U.S. Pat. Nos. 5,381,637 and 5,729,941, have been observed to exhibit penetration failures upon being impacted by a force equivalent to that of a 250-pound weight dropped from a height of ten feet because the end of the reinforcing bar is able to move to an edge of the flat metal seat, thereby pushing against the flat metal seat and permitting the reinforcing bar to penetrate the cap.

A simple example of an extended body impacting protective cover 1 at plural points, in rapid succession, will illustrate the improved protection of the present invention. In the event that a left-of-center impact is followed by a right-of-center impact, a flat seat might be more likely to be jarred out of position following the first impact, allowing the end of the reinforcing bar to immediately penetrate through the cap and leaving the reinforcing bar partially or wholly uncovered for the second impact. Seat 6 of the present invention, however, is more limited in its potential range of movement, and would be more likely to remain in a sufficiently protective position following the first impact.

Thus, the foregoing design provides improved protection against penetration failure under a variety of circumstances when a falling worker impacts the protective cap. Also, because seat 6 wraps around the end of the reinforcing bar, the protective cover according to this invention should be more resistant to failure due to loads or forces tending to shear cap section 4 from collar section 3.

The present invention is not limited to seats that are shaped like a frustrum of a cone. Rather, the invention encompasses any seat wherein retaining sides retain an end portion of a concrete reinforcing bar within the seat. For seat 6 shown in FIG. 3A, sides 6*b* are such retaining sides.

Figure 3B:
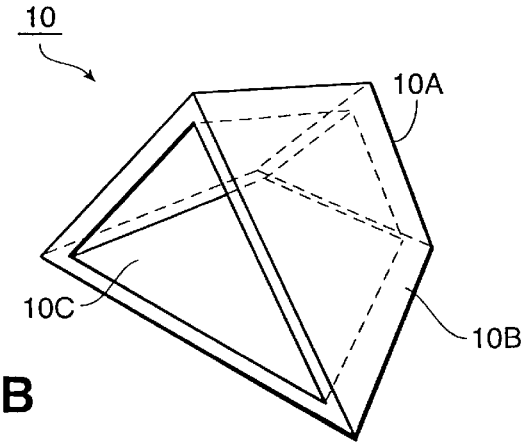

FIG. 3B shows an alternative seat for use with the present invention. Shown in FIG. 3B is seat 10 in a shape like a frustrum of a three-sided pyramid. Preferably, seat 10 has closed end 10*a*, retaining sides 10*b* and open end 10*c*.

Figure 3C:
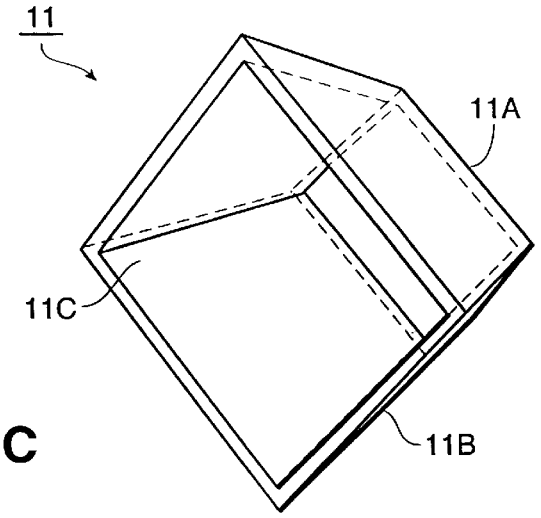

FIG. 3C shows another seat, in this case seat 11 shaped like a frustrum of a four-sided pyramid. Seat 11 has closed end 11*a*, retaining sides 11*b* and open end 11*c*. It should be noted that the invention is equally applicable to seats with a shape like a frustrum of a pyramid having any number of sides.

Figure 3D:
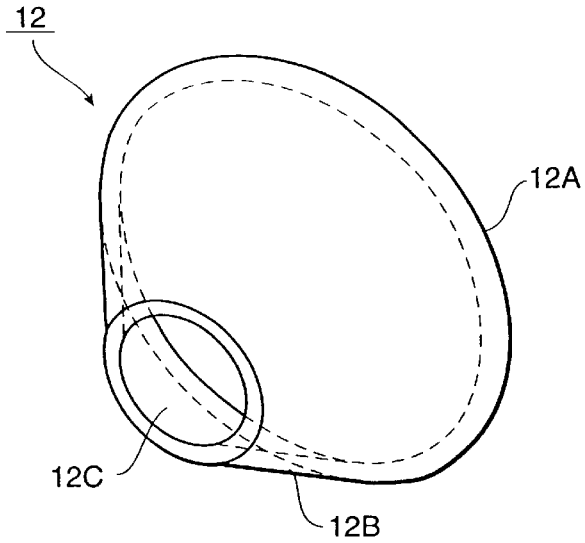

The seat need not have its open end larger than its closed end. For example, as shown in FIG. 3D, seat 12 is shaped like a frustrum of a cone, with closed end 12*a* larger than open end 12*c*. Retaining sides 12*b* of seat 12 retain an end portion of a reinforcing bar within the seat.

Figure 3E:
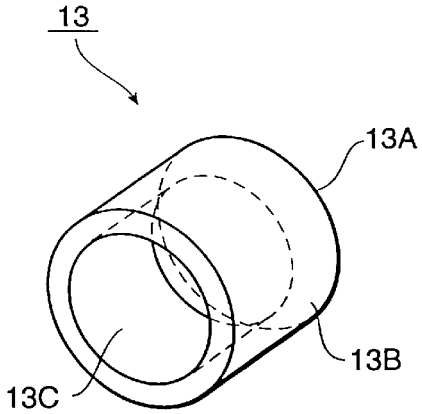

The open end and closed end of the seat also can be of the same size, as shown in FIG. 3E In this figure, seat 13 has closed end 13*a* and open end 13*c* that are substantially the same size. Thus, retaining sides 13*b* form a cylindrical-like shape.

Figure 3F:
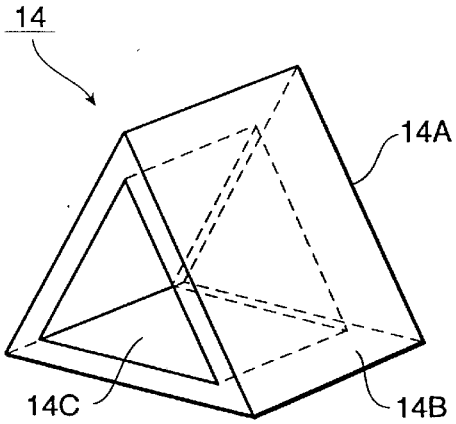
Figure 3G:
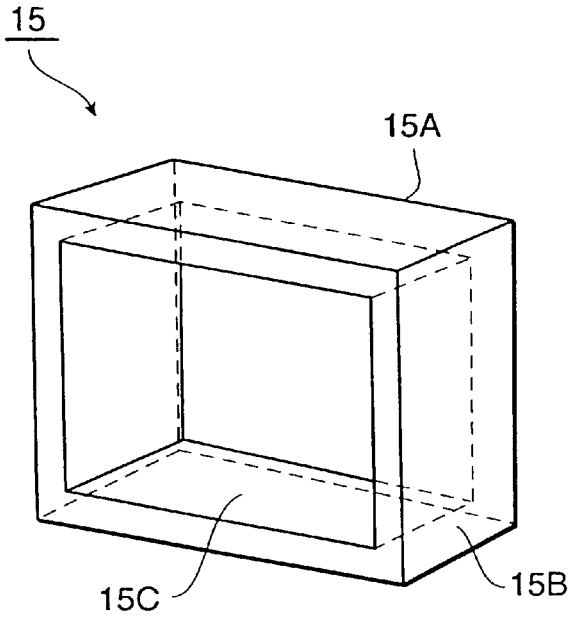

The seat also can be shaped like a prism, for example as shown in FIGS. 3F and 3G. In FIG. 3F, seat 14 has a prism-like shape having three sides. Seat 14 has closed end 14*a*, retaining sides 14*b*, and open end 14*c*.

Seat 15 in FIG. 3G is shaped like a four-sided prism (i.e., a box). Seat 15 has closed end 15*a*, retaining sides 15*b*, and open end 15*c*. Alternatively, the seat can be a prism-like shape having any number of sides.

Figure 3H:
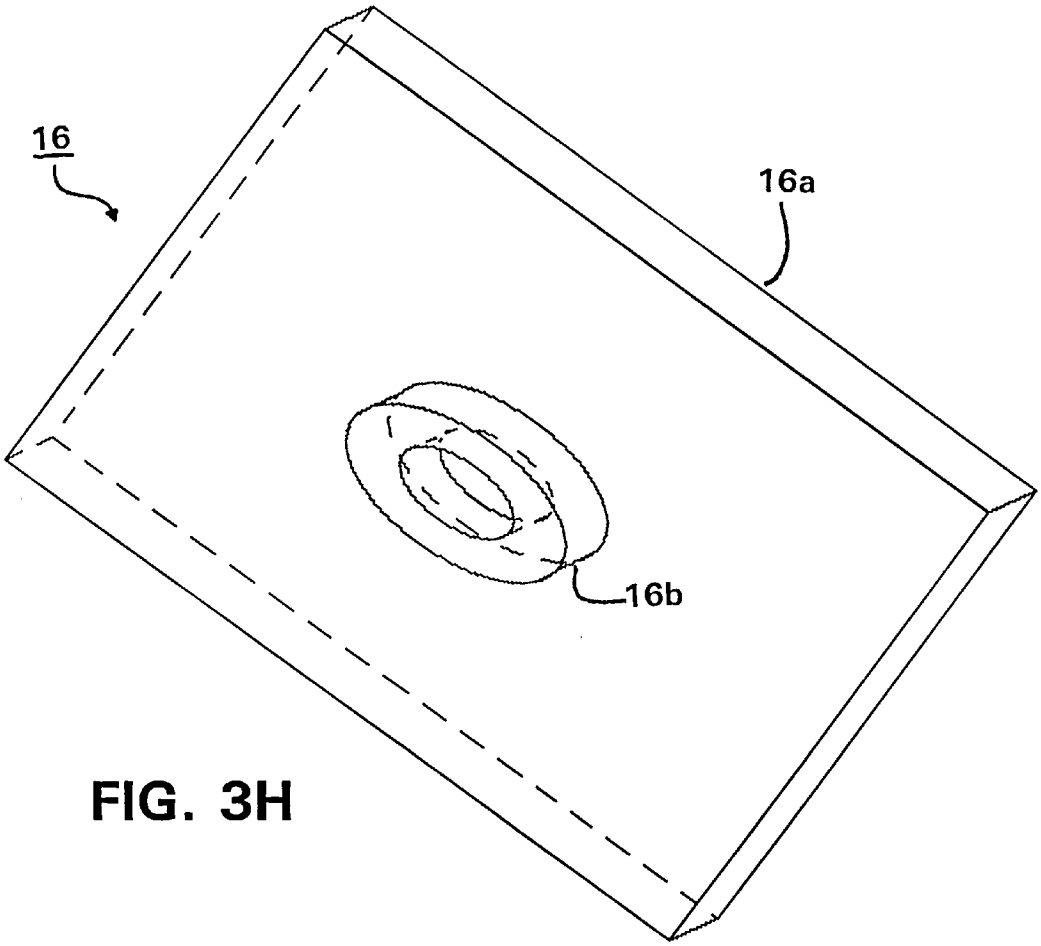

The retaining sides of the seat can be of any length, so long as they are sufficiently long to retain an end portion of a concrete reinforcing bar within the seat. In addition, the retaining sides need not align with or even have the same shape as the rest of the seat. For example, seat 16 in FIG. 3H has closed end 15*a* in the form of a square-shaped sheet and short retaining sides 16*b* substantially in the form of a washer-like shape. Closed end 15*a* can have any other suitable shape, such as a round shape, and retaining sides 16*b* can comprise, for example, a washer, a ring or the like integrally formed with or attached to closed end 16*a*.

While several examples of seats with retaining sides have been discussed above, it should be noted that the above examples are not exhaustive, and other types of seats with retaining means may be substituted for any or all of the above. Furthermore, while the seat is preferably made of a sufficiently-strong rigid metal material, any other sufficiently-strong material can be utilized.

Figure 4:
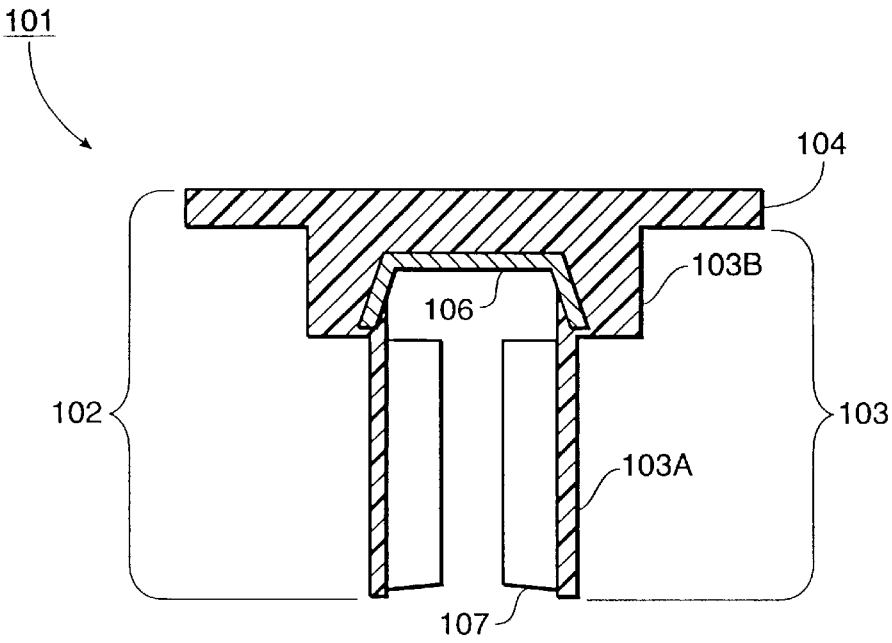
FIG. 4 depicts a longitudinal two-dimensional cross-section of the protective cover according to the second embodiment of the present invention.

The second embodiment of the present invention now will be discussed. FIG. 4 depicts a longitudinal two-dimensional cross-section of protective cover 101 according to this embodiment of the present invention. As shown in FIG. 4, protective cover 101 has an integrally-formed cap-and-collar assembly 102, including cap section 104 and collar section 103, which is injection-molded around seat 106.

It should be noted that while this embodiment is discussed with reference to a seat having a shape like a frustrum of a cone, this embodiment is equally applicable to any seat having retaining walls that retain an end portion of a concrete reinforcing bar within the seat. In particular, this embodiment is equally applicable to seats having shapes like those discussed with reference to FIGS. 3A through 3H above.

Collar section 103 includes small outer-diameter collar 103*a* and large outer-diameter collar 103*b*. Both collar 103*a* and collar 103*b* have the same inner diameter. Similar to the first embodiment, collar section 103 has inwardly-extending off-center fins 107 for grasping the reinforcing bar. Unlike the first embodiment, however, cap section 104 is attached to collar section 103 by collar 103*b* only. No reinforcing ribs are used. Otherwise, the second embodiment of the invention is physically and functionally identical to the first.

Figure 5:
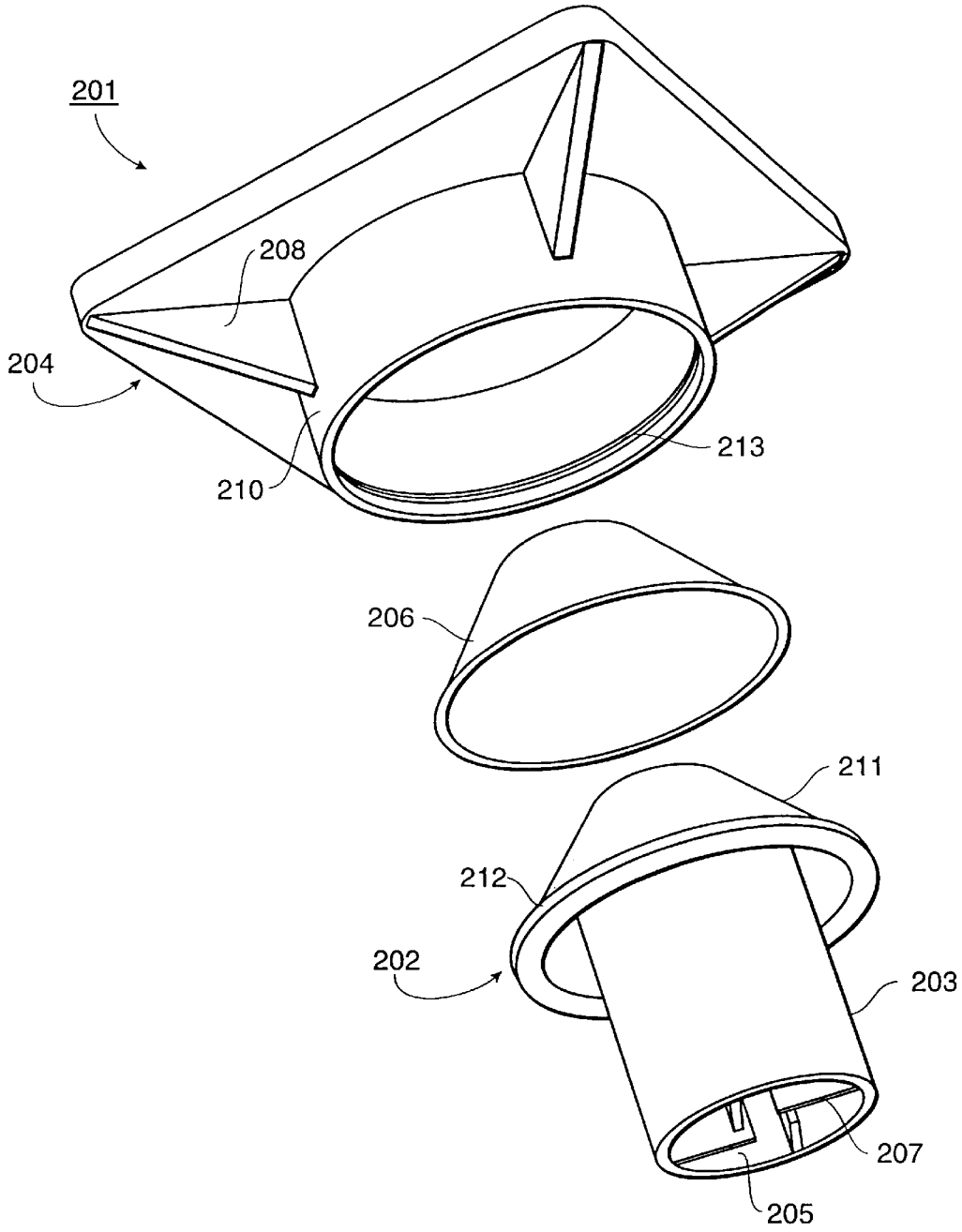
FIG. 5 is an exploded view of the protective cover according to the third embodiment of the invention.

The third embodiment of the present invention now will be discussed. This embodiment concerns a protective cover similar to the protective cover disclosed in the first embodiment, but rather than being integrally formed, several of the components are detachably assembled to form the protective cover. FIG. 5 is an exploded view of the third embodiment of the invention, showing protective cover 201 detached into its detachable component parts. As shown in FIG. 5, protective cover 201 has bar guard portion 202 which includes integrally-formed collar 203 and cap 211. Collar 203 has open end 205 for receiving the reinforcing bar and fins 207 for grasping the reinforcing bar.

As shown in FIG. 5, cap 211 is shaped like a frustrum of a cone. Alternatively, cap 211 can be of any shape along the lines of the seats discussed with reference to FIG. 3A through 3H above. In any case, lip 212 runs along the outer edge of cap 211.

Protective cover 201 also includes cover portion 204 and seat 206 which is disposed between bar guard portion 202 and cover portion 204. Cover portion 204 includes an open-ended collar-shaped receptacle 210 which is slightly smaller in diameter than lip 212 and which receives cap 211 of bar guard portion 202. The inner surface of collar-shaped receptacle 210 includes an inner groove 213 which is dimensioned to receive lip 212. Cover portion 204 also has four radially-extending reinforcing ribs 208, which provide additional structural rigidity, and a square flat top surface area, preferably having dimensions of four inches by four inches.

Again, while seat 206 is depicted in FIG. 5 as having a shape like a frustrum of a cone, seat 206 may be of any shape having retaining sides which retain an end portion of a concrete reinforcing bar therein, and in particular may be of any of the shapes discussed with reference to FIGS. 3A to 3H above.

In use, seat 206 is removably inserted into collar-shaped receptacle 210 with the closed end of seat 206 directed toward cover portion 204. Cap 211 is then detachably inserted into collar-shaped receptacle 210 with cap 211 directed toward the open end of seat 206, as shown in FIG. 5. When so detachably inserted, lip 212 partially bends back until lip 212 encounters groove 213, at which point lip 212 inserts into groove 213, thereby detachably securing bar guard portion 202 to cover portion 204.

As discussed previously, seat 206 preferably is ⅛-inch thick and is manufactured from hot-rolled A36 steel, and each of the other components is preferably made out of a resiliently-deformable plastic material, such as heavy-duty polyethylene plastic or rubber.

Although the preferred embodiment of the invention employs cap 211 and groove 213 to detachably secure bar guard portion 202 to cover portion 204, it is to be understood that resiliently-flexible lip 212 described above may be replaced by taps or fingers or the like or any conventional means for detachably securing two components, such as threading the two components or using screws, pins, clips or latches.

Once assembled, this embodiment of the invention operates identically to the first embodiment discussed above.

Figure 6:
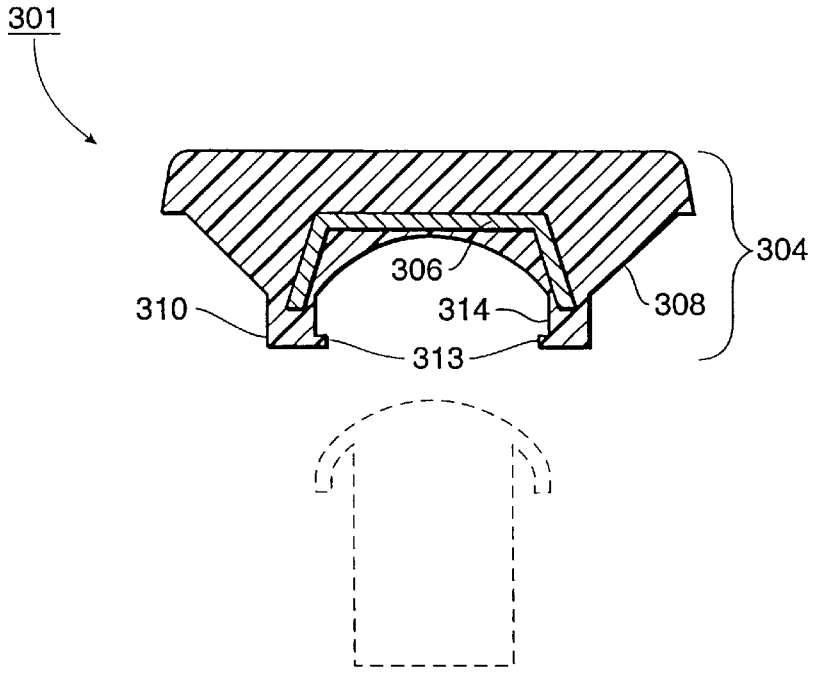
FIG. 6 depicts a longitudinal two-dimensional cross-section of the protective cover according to the fourth embodiment of the invention.

The fourth embodiment of the present invention now will be discussed. FIG. 6 depicts a longitudinal two-dimensional cross-section of this embodiment of the invention. As shown in FIG. 6, protective cover 301 includes cap section 304 which is integrally formed around seat 306. Again, seat 306 is depicted as having a shape like a frustrum of a cone. However, seat 306 can have any shape having retaining sides which retain an end portion of a concrete reinforcing bar therein.

Cap section 304 includes collar-shaped receptacle 310, which has an inner diameter large enough to permit insertion of a conventional mushroom-shaped bar guard, such as the type described in U.S. Pat. No. 4,202,378. Along the inner surface of collar-shaped receptacle 310 is inwardly-extending fingers or lip 313 and mushroom-shaped form 314. Fingers or lip 313 and mushroom-shaped form 314 permit protective cover 301 to be detachably secured to the conventional mushroom-shaped bar guard.

The inwardly-extending fingers or lip and the mushroom-shaped form shown in FIG. 6 preferably are made from resiliently-deformable material. For simplicity and brevity of description, the inwardly-extending securing means shall be referred to as a lip, although inwardly-projecting fingers may be used instead. In this regard, upon pushing protective cover 301 onto a conventional bar guard, lip 313 initially bends upward as the conventional bar guard is inserted, and then snaps back to again become perpendicular to collar-shaped receptacle 310 as the outer edge of the conventional bar guard passes lip 313. In this position, lip 313 supports the conventional bar guard from underneath the outer edge of its mushroom-shaped cap, thus detachably securing the conventional bar guard into cap section 304.

Four radially-extending reinforcing ribs 308 circle collar-shaped receptacle 310, connecting collar-shaped receptacle 310 to the rest of cap section 304, and providing rigidity and structural integrity for cap section 304.

Once again, it is preferable that seat 306 is ⅛-inch thick and is manufactured from hot-rolled A36 steel. Each of the other components is preferably made out of a resiliently-deformable plastic material, such as heavy-duty polyethylene plastic.

The invention has been described with respect to a particular illustrative embodiment. It is to be understood that the invention is not limited to the above described embodiment and that various changes and modifications may be made by those of ordinary skill in the art without departing from the spirit and scope of the invention.

What is claimed is:

1. A concrete reinforcing bar protective cover for covering an end of a concrete reinforcing bar so as to prevent injuries caused by coming into contact with an exposed end of the concrete reinforcing bar, said protective cover comprising:

an elongated cylindrical collar for securing the protective cover to the end of the concrete reinforcing bar;

a cap which is arranged perpendicularly to the elongated cylindrical collar; and a seat having retaining sides for retaining an end portion of the concrete reinforcing bar within the seat, the seat being disposed between the elongated cylindrical collar and the cap and is able to withstand an impact of a 250 pound weight without a penetration failure caused by the concrete reinforcing bar, wherein, when the concrete reinforcing bar protective cover is subjected to an impact while secured to the end of the concrete reinforcing bar, the retaining sides prevent the concrete reinforcing bar from being forced out from beneath the seat and penetrating the cap.

2. A protective cover according to claim 1, wherein the seat has a closed end and an open end, and wherein the seat is positioned such that the closed end is directed toward the cap.

3. A protective cover according to claim 1, wherein the elongated cylindrical collar further comprises inwardly extending off-center fins for detachably securing said protective cover to the exposed end of the concrete reinforcing bar.

4. A protective cover according to claim 1, further comprising reinforcing ribs for connecting the elongated cylindrical collar to the cap.

5. A protective cover according to claim 1, wherein the seat comprises a rigid metal material.

6. A protective cover according to claim 1, wherein the seat has a frustrum-like shape.

7. A protective cover according to claim 6, wherein the frustrum is of a cone-like shape.

8. A protective cover according to claim 6, wherein the frustrum is of a pyramid-like shape having at least three sides.

9. A protective cover according to claim 1, wherein the seat has a cylindrical-like shape.

10. A protective cover according to claim 1, wherein the seat has a prism-like shape having at least three sides.

11. A protective cover according to claim 1, wherein the seat has a sheet-like shape with retaining sides in a form of a washer or a ring.

12. A protective cover for covering an end of a concrete reinforcing bar so as to prevent injuries caused by coming into contact with an exposed end of the concrete reinforcing bar, said protective cover comprising:

a collar for securing the protective cover to the exposed end of the concrete reinforcing bar;

a cap which is arranged perpendicularly to the collar; and a seat having retaining means for retaining an end portion of the concrete reinforcing bar within the seat, the seat being disposed between the elongated cylindrical collar and the cap and is capable of withstanding an impact of a 250 pound weight without a penetration failure cased by the concrete reinforcing bar, wherein, when the protective cover is subjected to an impact while secured to the end of the concrete reinforcing bar, the retaining means prevent the concrete reinforcing bar from being forced out from beneath the seat and penetrating the cap.

13. A protective cover according to any one of claims 1 to 12, wherein the elongated cylindrical collar, the seat and the cap are integrally formed into a single unitary member.

14. A detachably assembled protective cover for covering an end of a concrete reinforcing bar so as to prevent injuries caused by coming into contact with an exposed end of the concrete reinforcing bar, said detachably assembled protective cover comprising:

a bar guard portion comprising a collar section integrally formed with a top portion at one end and dimensioned to receive within the collar the concrete reinforcing bar at the other end;

a cover portion having a bar guard receptacle detachably receiving the top portion of the bar guard portion and a cap which is arranged perpendicularly to said bar guard receptacle; and a seat having retaining walls for retaining an end portion of the concrete reinforcing bar, the seat being placed between the bar guard portion and the cover portion and is capable of withstanding an impact of a 250 pound weight without a penetration failure cased by the concrete reinforcing bar, wherein, when the protective cover is subjected to an impact while secured to the end of the concrete reinforcing bar, the retaining walls prevent the concrete reinforcing bar from being forced out from beneath the seat and penetrating the cover portion.

15. A detachably assembled protective cover according to claim 14, wherein the seat has a closed end and an open end, and wherein when the seat is positioned between the bar guard portion and the cover portion, the seat is oriented such that the open end of the seat is directed toward the bar guard portion when the bar guard portion is detachably received in the cover portion.

16. A detachably assembled protective cover according to claim 14, wherein the bar guard further comprises inwardly extending off-center fins for detachably securing said bar guard to the exposed end of the concrete reinforcing bar.

17. A detachably assembled protective cover according to claim 14, wherein said cover portion further comprises reinforcing ribs for connecting the bar guard receptacle to the cap.

18. A detachably assembled protective cover according to claim 14, wherein the seat and the cover portion are integrally formed into a single unitary member.

19. A detachably assembled protective cover according to claim 14, wherein the seat comprises a rigid metal material.

20. A detachably assembled protective cover according to claim 14, wherein the top portion of the bar guard comprises a cap having a lip around its outer edge, and wherein the bar guard receptacle is collar-shaped and comprises an inner groove adapted for receiving the lip of the cap.

21. A detachably assembled protective cover according to claim 14, wherein the top portion of the bar guard and the bar guard receptacle are each threaded, whereby the top portion of the bar guard can detachably screw into the bar guard receptacle.

22. A detachably assembled protective cover according to claim 14, wherein the top portion of the bar guard and the bar guard receptacle can be detachably secured to each other by at least one clip.

23. A detachably assembled protective cover according to claim 14, wherein the seat has a frustrum-like shape.

24. A detachably assembled protective cover according to claim 14, wherein the frustrum is of a cone-like shape.

25. A detachably assembled protective cover according to claim 23, wherein the frustrum is of a pyramid-like shape having at least three sides.

26. A detachably assembled protective cover according to claim 14, wherein the seat has a cylinder-like shape.

27. A detachably assembled protective cover according to claim 14, wherein the seat has a prism-like shape having at least three sides.

28. A detachably assembled protective cover according to claim 14, wherein the seat has a sheet-like shape with retaining sides in a form of a washer or a ring.

29. A detachably assembled protective cover for covering an end of a concrete reinforcing bar so as to prevent injuries caused by coming into contact with an exposed end of the concrete reinforcing bar, said detachably assembled protective cover comprising:

a bar guard portion comprising a collar section integrally formed with a top portion at one end and dimensioned to receive within the collar the concrete reinforcing bar at the other end;

a cover portion having a bar guard receptacle detachably receiving the top portion of the bar guard portion and a cap which is arranged perpendicularly to said bar guard receptacle; and a seat having retaining means for retaining an end portion of the concrete reinforcing bar, the seat being placed between the bar guard portion and the cover portion and is capable of withstanding an impact of a 250 pound weight without a penetration failure cased by the concrete reinforcing bar, wherein, when the protective cover is subjected to an impact while secured to the end of the concrete reinforcing bar, the retaining means prevent the concrete reinforcing bar from being forced out from beneath the seat and penetrating the cover portion.

30. A protective cover for attaching to a conventional bar guard, said conventional bar guard having a collar which includes inwardly extending fins for grasping a reinforcing bar and a mushroom-shaped top perpendicularly attached to said collar, said protective cover comprising:

a collar-shaped receptacle having inwardly extending means for detachably securing to the mushroom-shaped top of the conventional bar guard;

a cap which is perpendicularly attached to the collar-shaped receptacle; and a seat having retaining walls for retaining an end portion of the reinforcing bar, the seat disposed within the collar-shaped receptacle and is capable of withstanding an impact of a 250 pound weight without a penetration failure cased by the reinforcing bar, wherein, when the protective cover is subjected to an impact while secured to the end of the reinforcing bar, the retaining walls prevent the concrete reinforcing bar from being forced out from beneath the seat and penetrating the cap.

31. A protective cover according to claim 30, wherein the seat has a closed end and an open end, wherein the closed end of the seat is directed toward the cap, and wherein when the conventional bar guard is fixedly secured to the collar-shaped receptacle the open end of the seat is directed toward the mushroom-shaped top.

32. A protective cover according to claim 30, wherein the inwardly extending means comprises a lip made from a resiliently deformable material.

33. A protective cover according to claim 30, wherein the seat and the cap are integrally formed into a single unitary member.

34. A protective cover according to claim 30, further comprising reinforcing ribs for connecting the collar-shaped receptacle to the cap.

35. A protective cover according to claim 30, wherein the seat comprises a rigid metal material.

36. A protective cover according to claim 30, wherein the seat has a frustrum-like shape.

37. A protective cover according to claim 36, wherein the frustrum has a cone-like shape.

38. A protective cover according to claim 36, wherein the frustrum is of a pyramid-like shape having at least three sides.

39. A protective cover according to claim 30, wherein the seat has a cylinder-like shape.

40. A protective cover according to claim 30, wherein the seat has a prism-like shape having at least three sides.

41. A protective cover according to claim 40, wherein the seat has a sheet-like shape with retaining sides in a form of a washer or a ring.

42. A protective cover for attaching to a conventional bar guard, said conventional bar guard having a collar which includes inwardly extending fins for grasping a reinforcing bar and a mushroom-shaped top perpendicularly attached to said collar, said protective cover comprising:

a collar-shaped receptacle having inwardly extending means for detachably securing to the mushroom-shaped top of the conventional bar guard;

a cap which is perpendicularly attached to the collar-shaped receptacle; and a seat having retaining means for retaining an end portion of the reinforcing bar within the seat, the seat disposed within the collar-shaped receptacle and is capable of withstanding an impact of a 250 pound weight without a penetration failure cased by the reinforcing bar, wherein, when the protective cover is subjected to an impact while secured to the end of the reinforcing bar, the retaining means prevent the concrete reinforcing bar from being forced out from beneath the seat and penetrating the cap.

43. A protective cover for covering an end of a concrete reinforcing bar comprising:

a collar-shaped receptacle having an open end for receiving the end of the concrete reinforcing bar;

a cap which is arranged perpendicularly to the collar-shaped receptacle; and a seat having retaining sides for retaining the end of concrete reinforcing bar within the seat, the seat being disposed between the cap and the collar-shaped receptacle and is capable of withstanding an impact of a 250 pound weight without a penetration failure cased by the concrete reinforcing bar, wherein, when the protective cover is subjected to an impact while secured to the end of the concrete reinforcing bar, the retaining sides prevent the concrete reinforcing bar from being forced out from beneath the seat and penetrating the cap.

44. A protective cover according to claim 43, wherein the seat has a closed end and an open end, and wherein the closed end of the seat is directed toward the cap and the open end of the seat is directed toward the collar-shaped receptacle.

45. A protective cover for covering an end of a concrete reinforcing bar comprising:

a collar-shaped receptacle having an open end for receiving the end of the concrete reinforcing bar;

a cap which is arranged perpendicularly to the collar-shaped receptacle; and a seat having retaining means for retaining an end portion of the concrete reinforcing bar within the seat, the seat being disposed between the cap and the collar-shaped receptacle and is capable of withstanding an impact of a 250 pound weight without a penetration failure cased by the concrete reinforcing bar, wherein, when the concrete reinforcing bar protective cover is subjected to an impact while secured to the end of the concrete reinforcing bar, the retaining sides prevent the concrete reinforcing bar from being forced out from beneath the seat and penetrating the cap.

* * * * *

UNITED STATES PATENT AND TRADEMARK OFFICE

CERTIFICATE OF CORRECTION

PATENT NO. : 5,943,836

DATED : August 31,1999

INVENTOR(S) : Vasken Kassardjian

It is certified that error appears in the above-identified patent and that said Letters Patent is hereby corrected as shown below:

On title page, Item [56]

OTHER DOCUMENTS(Including Author, Title, Date, Pertinent Pages, Etc.)

"Exhibit'A': Report on bar guard", Gary Workman
"Exhibit'B': Report on rebar with metal insert" Gary Workman
Letter from William McLaughlin Signed and Sealed this Ninth Day of May, 2000

*Attest:*

Q. TODD DICKINSON

*Attesting Officer*

*Director of Patents and Trademarks*